US006102306A

United States Patent [19]

Ask et al.

[11] Patent Number: 6,102,306

[45] Date of Patent: Aug. 15, 2000

[54] MULTIFUNCTIONAL FLUSH SURFACE NOZZLE

[75] Inventors: Bernard J. Ask; Tom Ask, both of St. Simons Island, Ga.

[73] Assignee: Odin Systems International, Inc., St. Simons Island, Ga.

[21] Appl. No.: 09/173,418

[22] Filed: Oct. 16, 1998

[51] Int. Cl.[7] ..... B05B 15/06

[52] U.S. Cl. ..... 239/201; 239/63; 239/69; 239/75; 239/288; 239/548

[58] Field of Search ..... 239/201, 202, 239/207, 203, 63, 69, 71, 75, 200, 288, 288.3, 548, 556

[56] References Cited

U.S. PATENT DOCUMENTS

| | | | |
|---|---|---|---|
| 500,853 | 7/1893 | Clark | 239/201 |
| 706,289 | 8/1902 | Young | 239/202 X |
| 965,077 | 7/1910 | Carmack | 239/201 |
| 1,472,669 | 10/1923 | Overbaugh | 239/201 X |
| 1,710,844 | 4/1929 | Sherman | 239/201 X |
| 1,776,455 | 9/1930 | Thompson | 239/201 X |
| 1,962,534 | 6/1934 | Sweetland | 239/201 |
| 2,751,250 | 6/1956 | Block | 239/201 |
| 2,793,910 | 5/1957 | Wiebe | 239/201 |
| 3,009,648 | 11/1961 | Hait | 239/201 |
| 3,018,057 | 1/1962 | Anderson | 239/201 |
| 3,193,205 | 7/1965 | Hanson | 239/201 X |
| 3,201,006 | 8/1965 | Bernhardt . | |
| 3,540,655 | 11/1970 | Hinrichs . | |
| 3,662,956 | 5/1972 | Hedman | 239/201 |
| 4,209,131 | 6/1980 | Barash et al. . | |
| 4,852,802 | 8/1989 | Iggulden et al. . | |
| 4,895,303 | 1/1990 | Freyvogel . | |
| 5,021,939 | 6/1991 | Pulgiese . | |
| 5,060,859 | 10/1991 | Bancroft . | |
| 5,148,826 | 9/1992 | Bakhshaei . | |
| 5,287,888 | 2/1994 | Geiger . | |
| 5,447,272 | 9/1995 | Ask . | |
| 5,839,658 | 11/1998 | Sarver | 239/75 X |

FOREIGN PATENT DOCUMENTS

| | | | |
|---|---|---|---|
| 2225580 | 12/1974 | France | 239/201 |
| 406210204 | 8/1994 | Japan | 239/201 |

OTHER PUBLICATIONS

Odin Systems, "Automated Anti–Icing Systems Extend the Reach of Winter Road Maintenance Crews," Brochure, 1997.

Maintenance Specialties, Inc., "Training and Implementation of Technology as a Means of Reducing the Cost of Maintenance," Brochure.

Ask, B., APWA Reporter, Aug. 1996, pp. 21.

*Primary Examiner*—Andres Kashnikow
*Assistant Examiner*—Steven J. Ganey
*Attorney, Agent, or Firm*—James Creighton Wray; Meera P. Narasimhan

[57] ABSTRACT

A nozzle for spraying deicing liquid onto surfaces lies flush with surfaces to prevent obstruction of surface treatment. The nozzles may be integral nozzles formed with the surface and may have relief channels designed to spread spray into a stream or a flatter pattern by adsorption of the streaming spray to the relief channel. The nozzles may be adapted for mounting and have an alignment base. An integral check valve and a flow switch are provided in the system. Additionally, either combined with the movement of the nozzle assembly or independently, a pump is regulated to vary the substance flow and pressure to get the desired spray distance and droplet size. Different programs may drive the nozzle and pump assembly depending on the target surface and rheology of the substance under the conditions to be sprayed. The nozzle may be of composite material, stainless or other metal, cast or molded. A groove at the base of the nozzle accommodates epoxy used during installation and aids in forming a tight bond between the nozzle, epoxy, and pavement. An inlet permits supply of anti-icing liquid to the nozzle, which is suited for varied applications. A flat surface installation guide protects the installation gig from debris, glue, epoxy, etc. The gig is temporarily affixed to the device to be mounted flush with the pavement. A streaming or fan-shaped spray nozzle is aimed in such a manner that the deicing liquid covers entire targeted surfaces. The device includes sensors and instruments to measure surface conditions and events. Wear indicators permit easy identification of worn out nozzles.

70 Claims, 8 Drawing Sheets

MULTIFUNCTIONAL FLUSH SURFACE NOZZLE

BACKGROUND OF THE INVENTION

The application of anti-icing chemicals to surfaces by applying the liquid via spray nozzles is a well established practice, and devices used for spraying liquid anti-icing agents currently exist. However, all those devices are truck or trailer mounted, while the current invention is a surface mounted nozzle device.

No adjustable nozzle mechanism is known for providing an adjustable permanent nozzle installation to provide icing protection by a stationary, liquid anti-icing agent distribution system flush mounted with surface to be treated.

SUMMARY OF THE INVENTION

The present invention provides a machine that applies chemical anti-icing agents to any surface to be protected from snow and ice, i.e., driveways, walkways, rooftops, etc. More specifically, the device is affixed to stationary surfaces and permits adjustment to spray nozzles. That permits the application of the substances, such as but not limited to, liquid chemical anti-icing agents, to the target surfaces by spraying the liquid in a manner intended to prevent snow and ice from forming a bond with the target surface.

An objective of the present invention is to provide a device that permits the permanent installation of spray nozzles on, in or near the surface intended to be protected by a liquid chemical anti-icing compound, such as potassium acetate, calcium magnesium acetate, magnesium chloride, etc. by automatic, manual and remote control means.

The present invention is easily maintained and left in a state of preparedness for use in the event of icing conditions. The invention provides a durable, adjustable and permanent point of attachment for spray nozzles for anti-icing purposes. A primary benefit is a greatly increased margin of safety for the users of the driveways, sidewalks, etc.

The present invention relates to nozzles for spraying anti-icing liquid onto surfaces. A preferred nozzle may lie flush with the surface to be treated. That design prevents obstruction of surface treatment (plowing, resurfacing etc.). Moreover, it allows the nozzle to be closely located to the target surface without requiring a long spraying distance.

The nozzle may be flush with the surface of the area to be protected. It may be of composite material, stainless or other metal, cast or molded.

A groove at the base of the nozzle accommodates epoxy used during installation and aids in forming a tight bond between the nozzle, epoxy, and pavement.

An inlet, either on the bottom, top or side surfaces, permits a connecting tube or opening to supply substances to the nozzle outlet, which is suited for varied applications such as, but not limited to, bridge decks, parking ramps, etc.

In a preferred embodiment, the nozzles may be integral nozzles formed with the surface. Preferably relief channels may be connected to the nozzles. Preferred relief channels are designed to spread spray into a pattern by adsorption of the streaming spray to the relief channel and by angling the relief channels as desired.

The nozzles may be adapted for mounting and/or may have an alignment base. A check valve, preferably integral, may be provided in the system. A preferred embodiment may include an integral flow switch or regulator.

Additionally, either combined with the positioning of the nozzle assembly or independently, the angle of the relief channels in the nozzle, and the angle of repose of the nozzle along the mounted surface provides varied spray distances over smaller or larger areas, as desired. Moreover, a pump may be regulated to vary the pressure and substance flow to the nozzle, and to get the desired spray distance and droplet size.

Different programs may drive the nozzle and pump assembly depending on the target surface and rheology of the substance under the conditions to be sprayed.

A simplified actuator system has a single actuator to drive the nozzle over a cam follower.

A preferred method of installation and alignment of flush mounted cylindrical devices includes a flat surface installation guide with or without standoffs, which protect the installation jig from debris, glue, epoxy, etc. The jig is temporarily affixed to the device to be mounted along the pavement.

The preferred device comprises a flat surface of metal, plastic or any suitable material with openings for bolts or other fasteners to penetrate the installation jig and attach to the nozzle device to be flush mounted along the surface.

An access hole is provided for injecting or otherwise introducing epoxy or equivalent into the void underneath and or around the device to be installed flush with the surface.

In a preferred embodiment a streaming or fan-shaped spray nozzle may be aimed in a precise pattern while installing such that the anti-icing liquid covers entire targeted surfaces.

The invention may include sensors for resistance measurements to determine chemical presence, conductivity sensors, and the like.

The automated anti-icing spray system uses automatic control of the nozzle to cover a large target area with an anti-icing liquid spray.

A preferred embodiment includes instrumentation to measure surface conditions and events. That includes measurement of, but is not limited to, temperature, precipitation, traffic count, vehicle weight, and vehicle length and the like. The nozzle may include sensors for temperature, moisture, humidity, ambient conditions, pavement conditions, and the like.

The installation alignment device may be constructed of rigid metal or other suitable material in the form of a bar, rod, angle iron, or any other shape to form a rigid straight alignment edge. That allows for suspending the device to be flush mounted in the opening into which it is to be mounted, and keeping the device to be mounted flush with the surface of the material into which it is to be mounted.

A preferred embodiment has wear indicators to permit easy identification of worn out nozzles. Generally, the wear indicator may include etched lines that intercept a diagonal hole (typically one of the spray holes).

Alternatively, the wear indicator may be a surface plate made of at least two laminates. The lower laminate may be of a high visibility color or comprise infrared signature so that when the top laminate is worn off, the underlying laminate is easily identifiable.

The preferred nozzle is typically fabricated of nylon or stainless steel and may contain any number of nozzle orifices. A preferred embodiment may have two to six integral nozzle orifices. The angle of the nozzles may be determined at installation to provide the desired coverage. The spray hole diameter may be sized for required flow rate and droplet size. The spray angle is sized to provide a desired maximum height and distance of spray over the surface to be treated.

A fan plate attachment fits over the nozzle and the gap may be adjusted to produce the desired fanning characteristics. In highway applications, the nozzle may be located at any desired location, preferably in the traffic lanes. For airport and commercial applications, the nozzles are located throughout the surfaces to be treated to achieve the desired spray coverage.

These and further and other objects and features of the invention are apparent in the disclosure, which includes the above and ongoing written specification, with the claims and the drawings.

DETAILED DESCRIPTION OF THE PREFERRED EMBODIMENT

Figure 1:
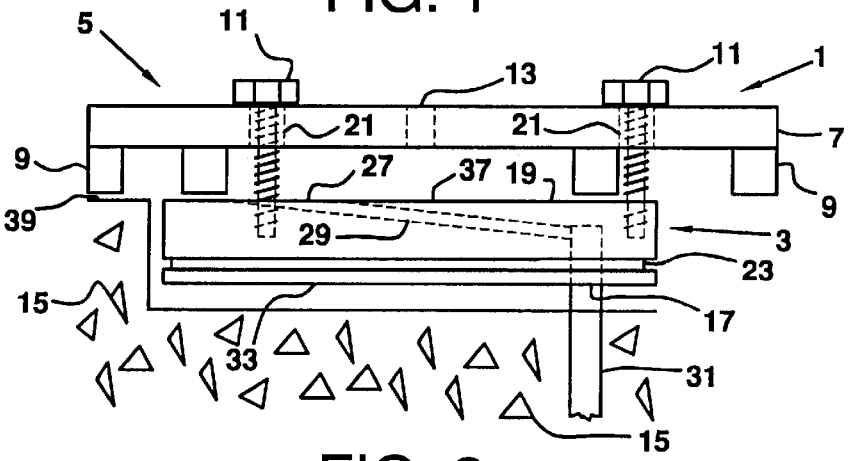
FIG. 1 is a side elevation of the inventive nozzle with a removable installation device.
Figure 2:
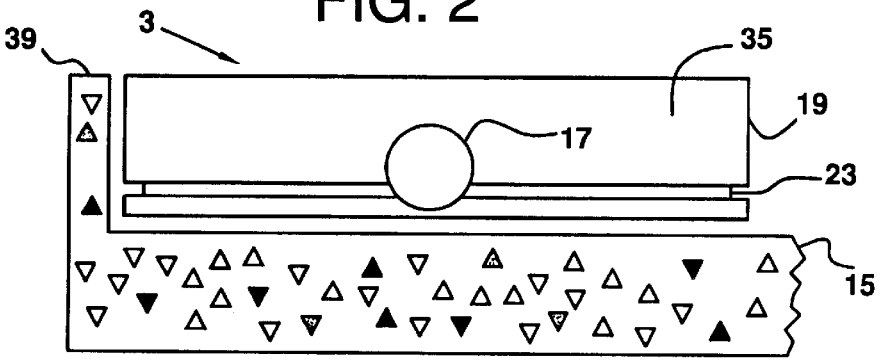
FIG. 2 is a side elevation of the nozzle assembly with an anti-icing agent inlet in the side of the nozzle block.

Referring to FIGS. 1–5B, in a preferred embodiment, the anti-icing system 1 includes a flush surface mounted nozzle assembly 3 and an installation assembly 5 for installing the nozzle assembly 3. Nozzle 3 may be pressed into the pavement when relaying or resurfacing. Alternatively, a small slot or trench may be provided to fit the nozzle within with any bonding agent. Installation assemblies may be provided for holding and fixing the nozzle into the pavement and then removing after installation.

Installation assembly 5 consists of an installation plate 7 for alignment of the system with the surface 39 on which it is installed. In a preferred embodiment, the installation assembly 5 has stand-off gauges 9 which further assist in the alignment. The stand-off gauges 9 rest upon the surface 39 on which the nozzle assembly 3 is to be installed.

Fasteners 11 temporarily secure the installation plate 7 to the nozzle block 19. Holes 21 and 41 in the installation plate 7 and the nozzle block 19, respectively, receive the temporary fasteners 11. An access hole 13 in the installation plate 7 allows for the introduction of an epoxy or its equivalent.

Figure 5A:
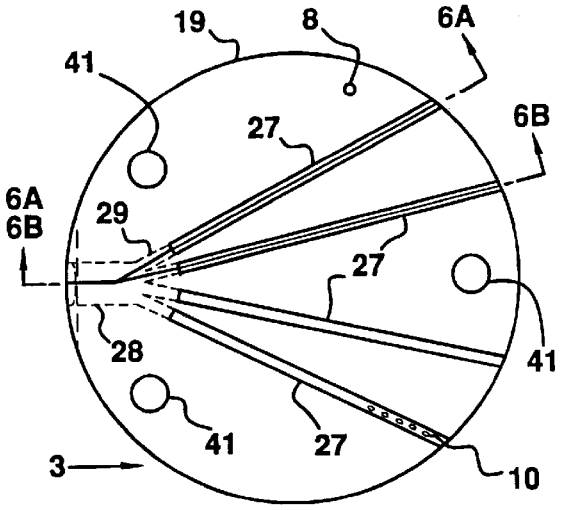
FIGS. 5A and 5B are top views of nozzle assemblies.
Figure 5B:
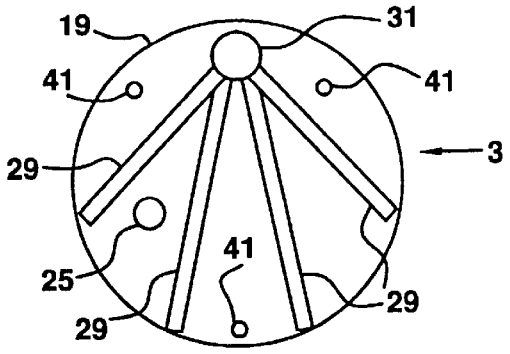

As shown in FIG. 5B, the epoxy drains through the access hole 13 in the installation plate 7 into an access hole 25 in the top surface 37 of the nozzle block 19. The epoxy flows from the access hole 25 to the groove 23 in the nozzle block 19 and into the void surrounding the nozzle block. The groove 23 at the base of the nozzle block 19 accommodates epoxy used during installation and aids in forming a tight bond between the nozzle block, epoxy, and pavement 15. When the epoxy hardens, the fasteners 11 are removed from the nozzle block 19. The installation assembly 5 is lifted away, leaving the nozzle assembly 3 flush-mounted with the surface 39.

Figure 3:
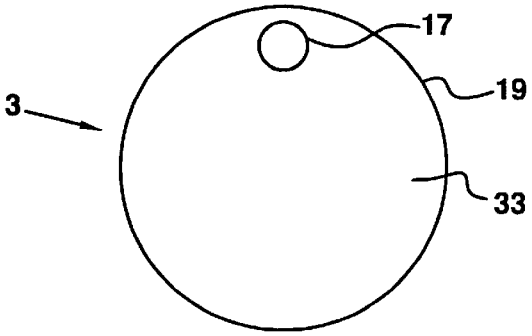
FIG. 3 is a bottom view of a cylindrical nozzle block.
Figure 4:
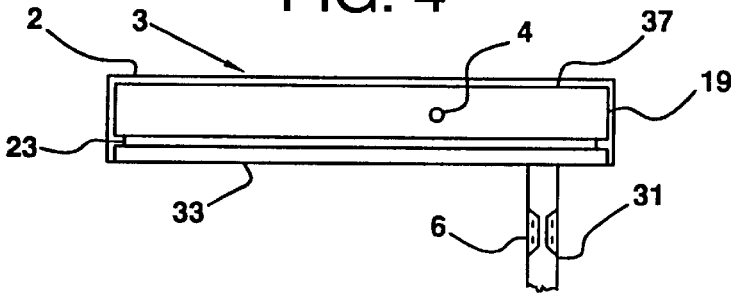
FIG. 4 is a side elevation of the nozzle assembly and inlet piping.

The anti-icing agents are supplied to the nozzle assembly 3 from a preexisting supply tube 31. The inlet and outlet of the nozzle may be located on any surface. The inlet 17 in the nozzle block 19 is on the bottom surface 33 of the block, as shown in FIGS. 1, 3, and 4. In another embodiment, the inlet 17 is located on a side surface 35 of the block, as shown in FIGS. 2, 5A, 6A, and 6B. The outlet or relief channel 27 in the nozzle block 19 is located on the top surface 37 of the block, as shown in FIG. 1.

In a preferred embodiment, the nozzle block 19 is circular, as shown in FIG. 3. The nozzle 19 block may be made of any suitable corrosion resistant material, such as but not limited to, nylon or stainless steel. As seen in FIG. 4, the nozzle may include sensors. A pavement temperature sensor 4 may be provided on the nozzle. A flow regulator 6 may be provided in the inlet supply 31. The flow regulator may be provided on the nozzle. Replaceable cover or extension ring 2 may be provided for covering the nozzle during resurfacing or repaving to protect the nozzle. Cover or ring 2 may be pulled off after the relaying.

As shown in the preferred embodiment in FIGS. 5A and 5B, the nozzle 19 may contain from one to several relief channels 27 connected to inlet 28 by connectors, such as tubes or openings 29, for distributing the anti-icing agents to the targeted surfaces. Ambient temperature sensor 8 may be provided anywhere on the nozzle. Conductivity sensors 10 are provided in the channels 27 for measuring the conductivity of the substances. Flow switch 12 may be provided in the inlet to control and monitor flow of substances.

Figure 6A:
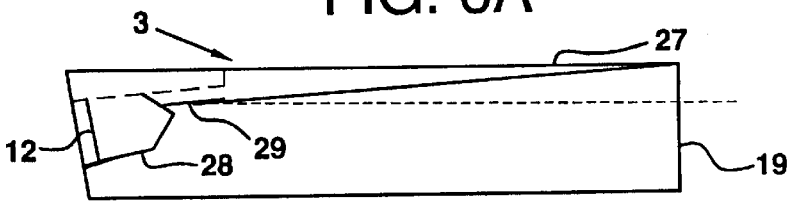
FIGS. 6A and 6B are cross-sections through the nozzle slots of FIG. 5A.
Figure 6B:
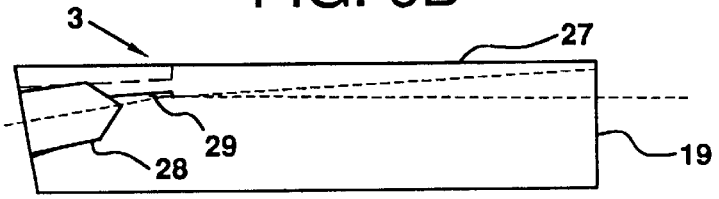

As shown in FIGS. 6A and 6B, angles of the relief channels 27 may be selected based upon the desired anti-icing agent distribution characteristics, the location of the nozzle, the area to be covered with the spray and the like. The angling of the relief channels may be used to control the area that the anti-icing spray covers. The channel diameter is sized for the required flow rate and droplet size. The spray angle is sized to provide a desired maximum height and distance of anti-icing spray over the targeted surface.

Figure 7:
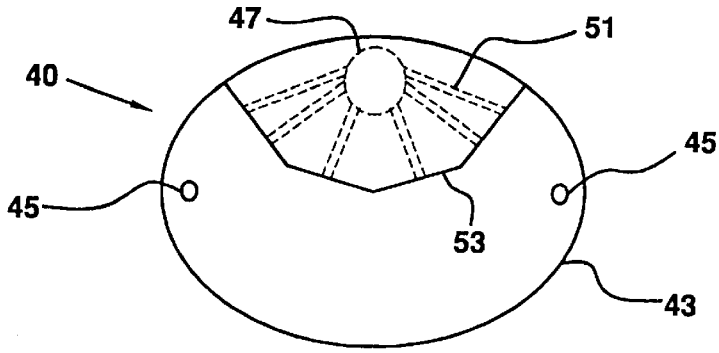
FIG. 7 is a top view of a nozzle assembly.
Figure 8A:
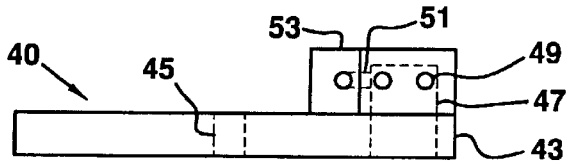
FIGS. 8A and 8B are side and front elevations of a nozzle assembly.
Figure 8B:
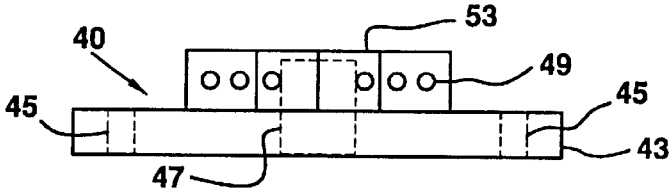

Referring to FIGS. 7, 8A and 8B, another preferred embodiment of a nozzle assembly 40 includes an alignment plate 43 and a nozzle housing 53. Anti-icing agents are supplied to channels 51 through inlet 47. Anti-icing agents exit the nozzle housing 53 through spray holes or relief channels 49. Mounting holes 45 receive fasteners from the installation assembly for mounting the alignment plate 43 to the targeted surface.

Figure 9:
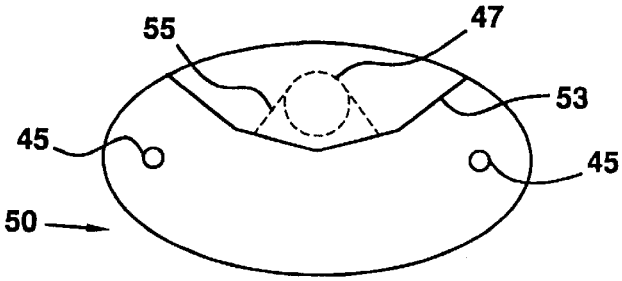
FIG. 9 is a top view of a nozzle assembly with a fan nozzle.
Figure 10:
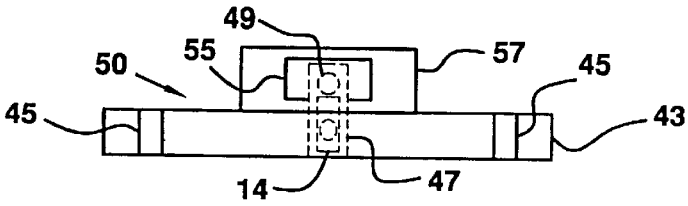
FIG. 10 is a side elevation of a nozzle assembly with a fan nozzle.

In another preferred embodiment, anti-icing agents may be sprayed over a continuous arc by a fan nozzle assembly 50, as shown in FIGS. 9 and 10. The fan plate 57 fits over the inlet 47 for receiving anti-icing agents. Through the use of a fan nozzle 55, anti-icing agents may be distributed onto the targeted surface in a continuous, wide arc or circumferentially. Anti-icing agents exit the fan plate 57 through spray holes 49. Mounting holes 45 receive fasteners from the installation assembly for mounting the alignment plate 43 to the targeted surface. Check valve 14 may be provided in the inlet.

Figure 11:
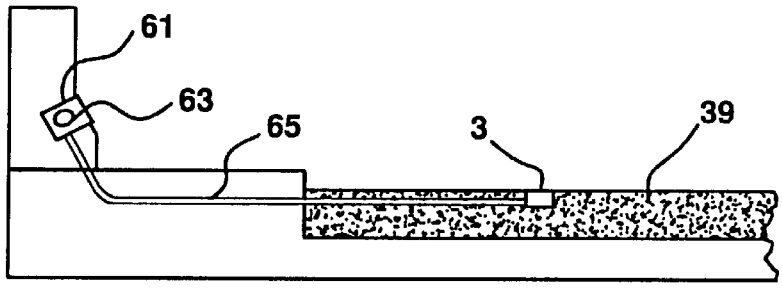
FIG. 11 is a side elevation of a nozzle assembly and supply piping installed in a roadway with a railing system.
Figure 12:
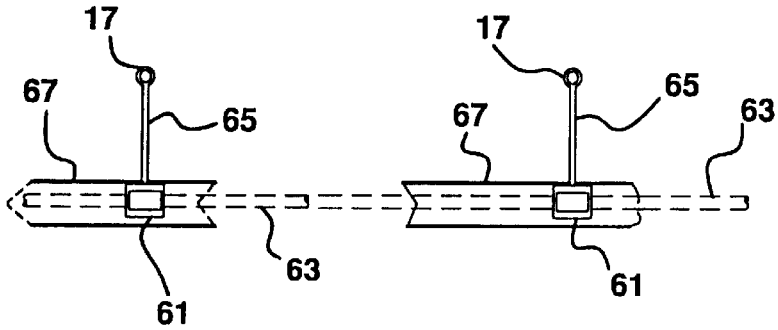
FIG. 12 is a top view of a junction box and supply piping.

As shown in FIGS. 11 and 12, a junction box 61 receives a supply of anti-icing agent through manifold 63. Conduit 65 feeds anti-icing agent from the junction box 61 to the inlet 17 of the nozzle assembly 3. Different diameter conduits 65 may be used for controlling the amount of anti-icing agent that is supplied to the nozzle assembly 3. In a preferred embodiment, the junction box 61 and supply manifold 63 are housed within a structure adjacent the targeted surface 39, such as a guardrail 67.

Figure 13:
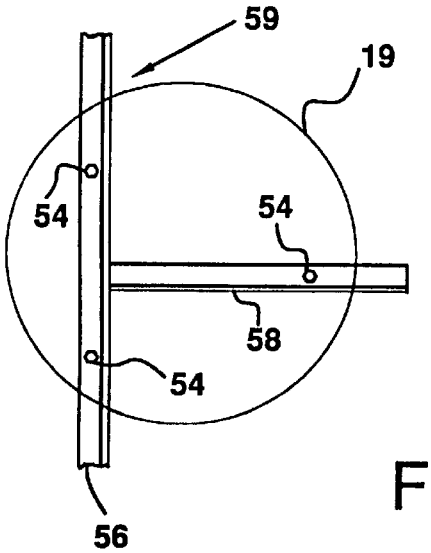
FIG. 13 is a top view of a T-shaped installation jig.
Figure 14:
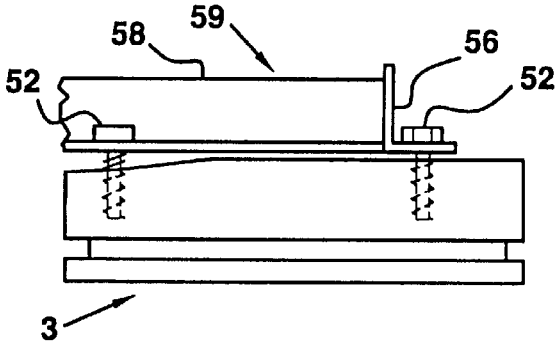
FIG. 14 is a side view of a T-shaped installation jig.
Figure 15:
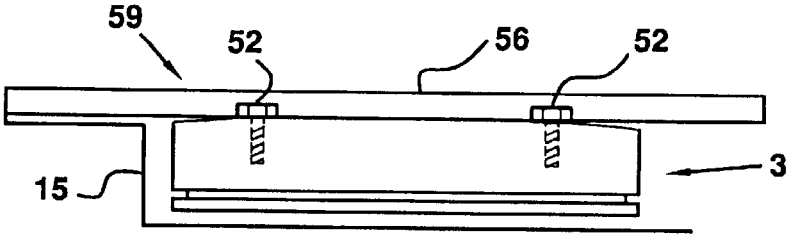
FIG. 15 is a side view of a T-shaped installation jig.

FIGS. 13, 14 and 15 show a T-shaped installation assembly 59. The T-shaped installation assembly 59 has two segments 56 and 58. The segments may be constructed of rigid metal or other suitable material, and in the form of a bar, rod, angle iron or other shape. The installation assembly 59 forms a rigid, straight alignment edge for maintaining the nozzle assembly 3 flush with the surface into which it is being mounted while suspending the nozzle assembly within the surface. Fasteners 52 in mounting holes 54 in segments 56 and 58 secure the nozzle assembly 3 to the installation assembly 59 during flush mounting of the nozzle assembly. Once the nozzle assembly 3 is flush-mounted, the fasteners 52 are removed from the nozzle assembly and the installation assembly is lifted away.

Figure 16:
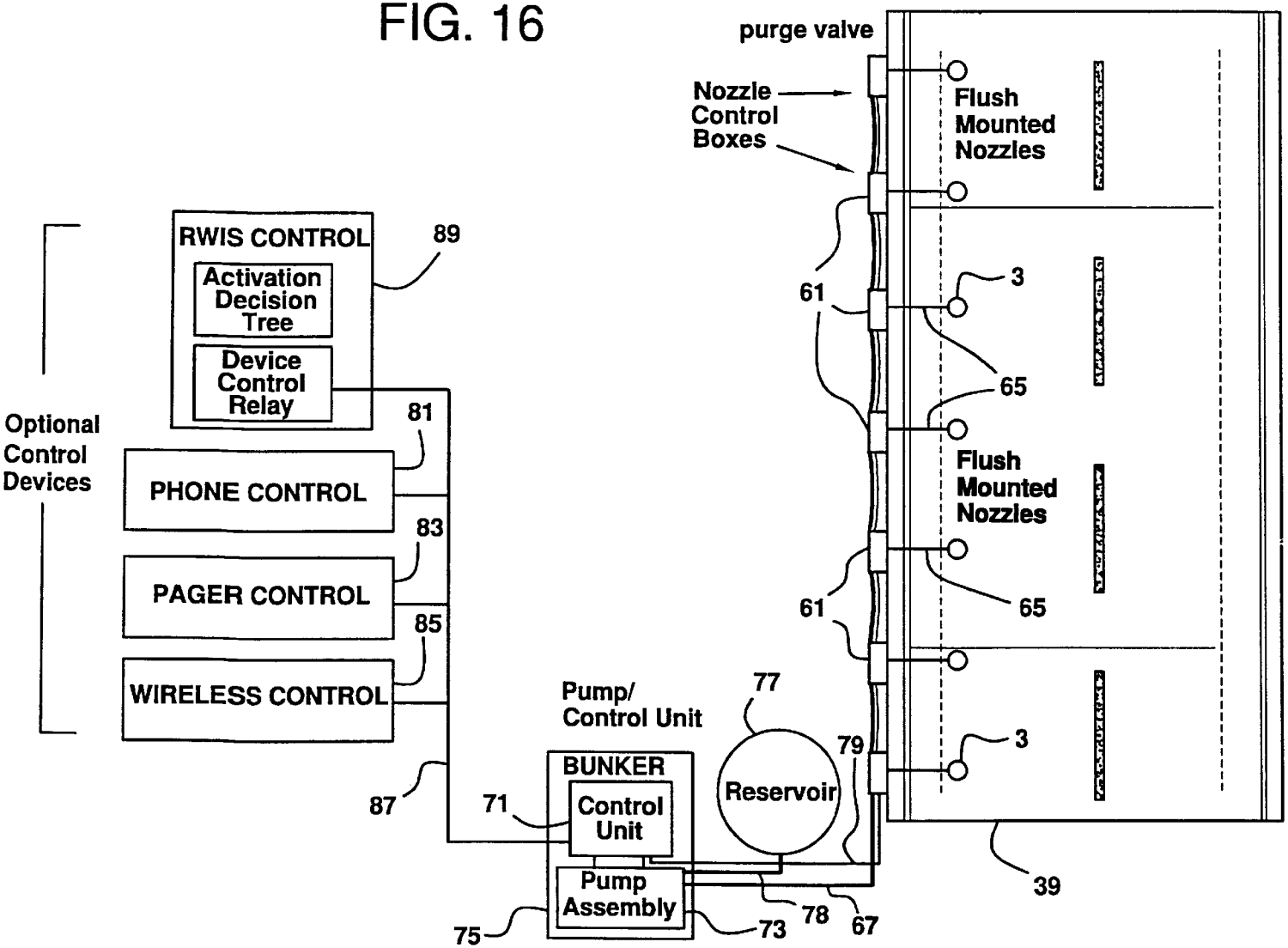
FIG. 16 is a flowchart for the operation of the flush-mounted surface nozzle.

FIG. 16 shows a flowchart of the operation of the flush-mounted surface nozzle. The electrical control unit 71 and the pump assembly 73 are housed in an enclosure 75 near the targeted surface 39. A reservoir 77 contains a supply of anti-icing agent. The pump assembly 73 receives anti-icing agent through inlet piping 78 and pumps anti-icing agent to the junction boxes 61 through supply manifold 67. Conduits 65 supply anti-icing agent from the junction box 61 to the nozzle assembly 3. Wiring 79 sends the electrical signals from the control unit 71 to the junction boxes 61 for controlling the distribution of the anti-icing agents to the targeted surface 39. In preferred embodiments, the control unit 71 may be remotely controlled by either phone control 81, pager control 83 or wireless control 85. Road/runway weather information system (RWIS) control 89 may also be a method of controlling distribution of anti-icing agent distribution to a targeted surface. Instructions are carried from the remote control site 81, 83, 85 or 89 to the control unit 71 by wiring 87. Flow pressures may be varied as desired as well as flow distances. Pressure may be varied within one nozzle or between nozzles installed at periodic intervals.

Figure 17:
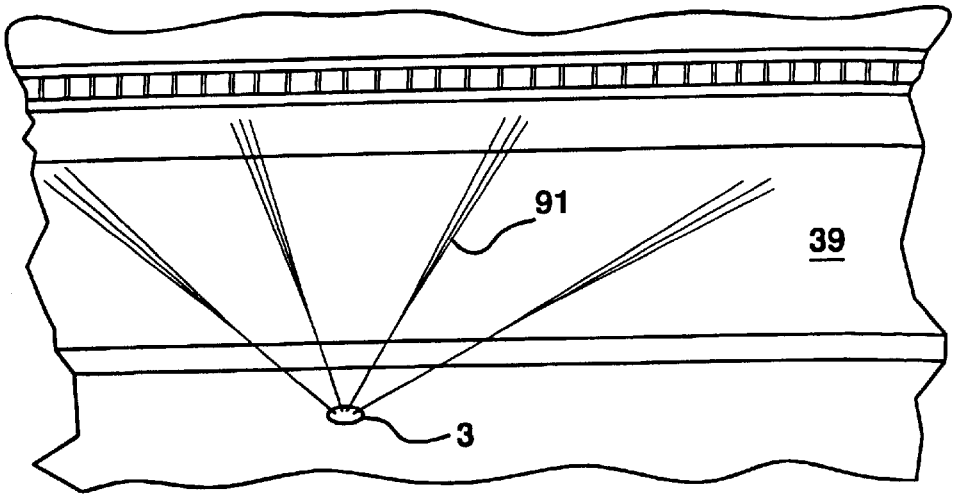
FIG. 17 is a perspective view of the flush-mounted surface nozzle while in use.
Figure 18:
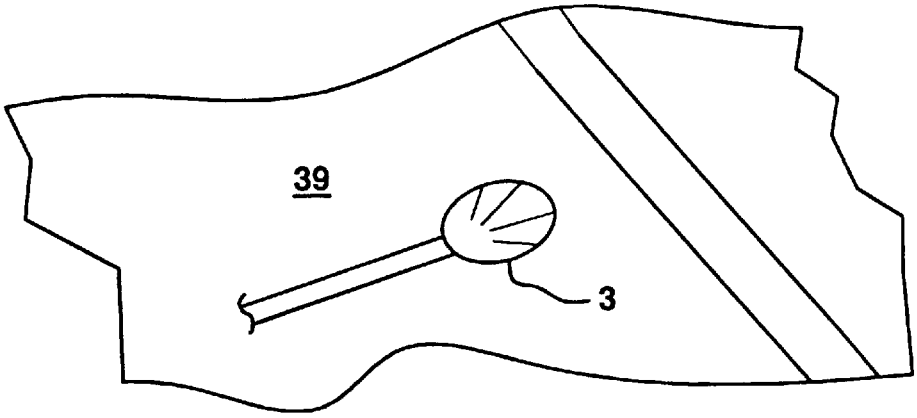
FIG. 18 is a perspective view of a nozzle assembly.

FIG. 17 shows a flush-mounted surface nozzle assembly 3 during actual operation. In the illustrated embodiment, the nozzle assembly 3 contains four channels creating four separate streams 91 of anti-icing agent being sprayed onto the targeted surface 39.

Figure 19:
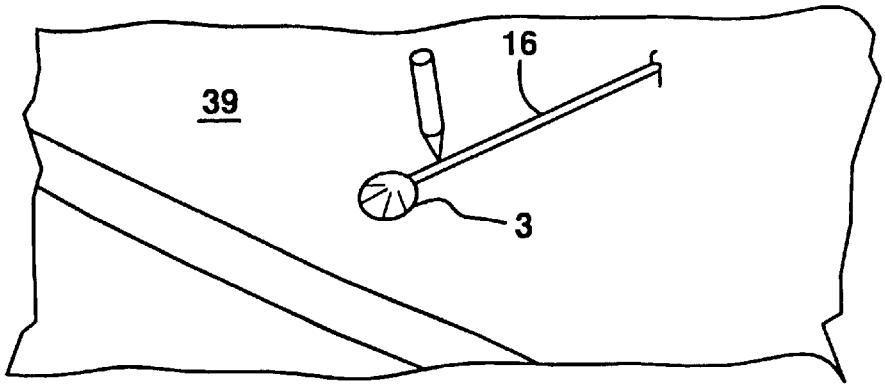
FIG. 19 is a perspective view of a nozzle assembly.
Figure 20:
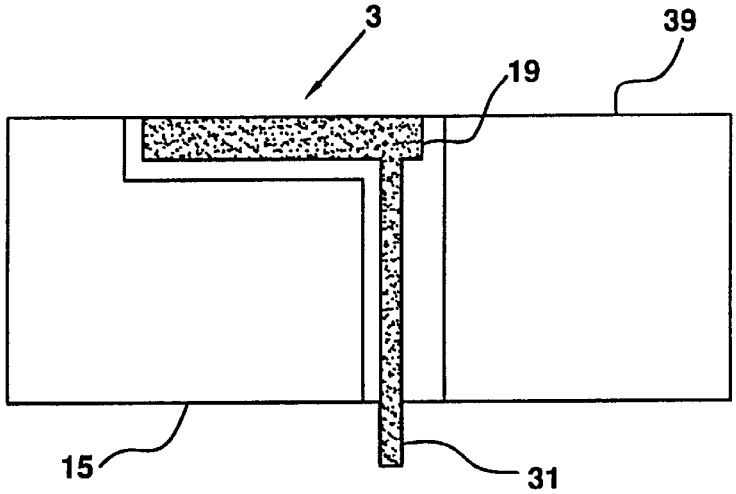
FIG. 20 is a side view of a nozzle assembly.
Figure 21:
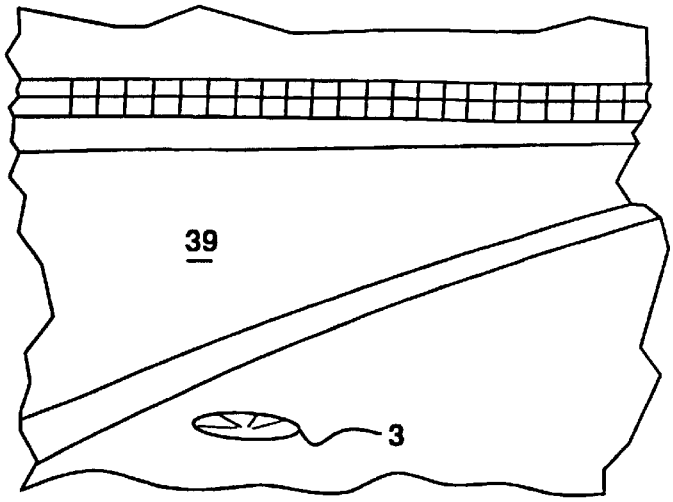
FIG. 21 is a perspective view of a nozzle assembly.
Figure 22:
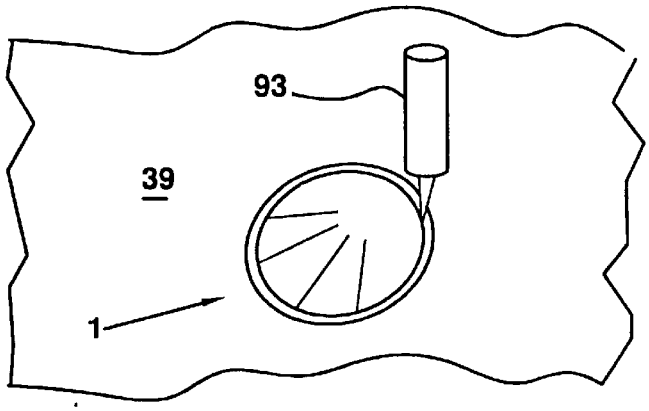
FIG. 22 is a perspective view showing epoxy being supplied to a nozzle assembly.
Figure 23A:
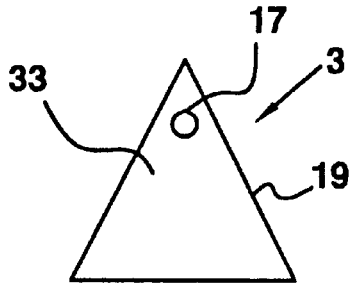
FIGS. 23A–23E show varying shapes of the nozzle.
Figure 23B:
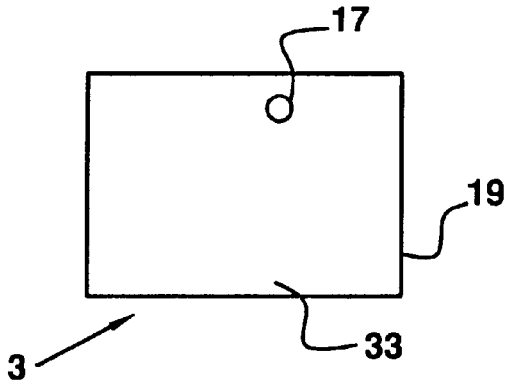
Figure 23C:
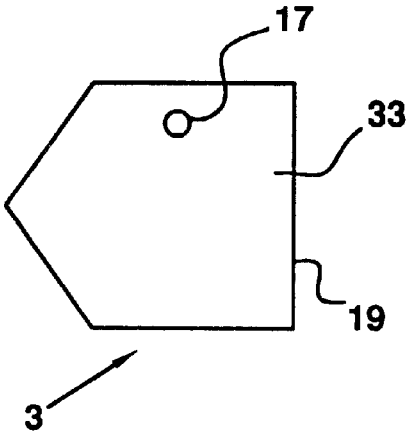
Figure 23D:
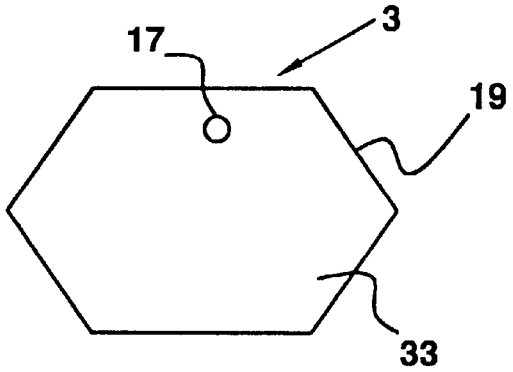
Figure 23E:
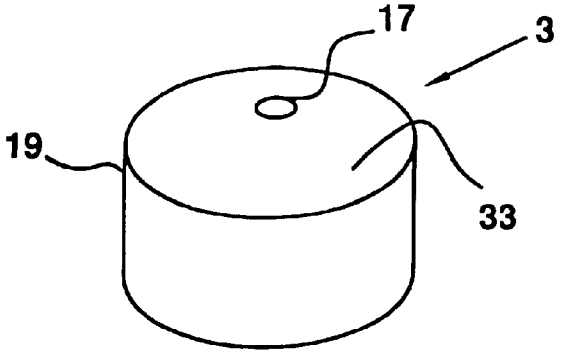

FIGS. 18–22 illustrate a flush-mounted surface nozzle 3 mounted in a roadway 39. Since the nozzle assembly 3 is flush with the roadway 39, it does not create an obstruction of the targeted surface. This feature also allows the nozzle assembly 3 to be located near the targeted surface 39, thus eliminating a long spraying distance. As shown in FIG. 19, a trench supply line 16 may be inherently provided along the surface to accommodate a supply pipe to the nozzle inlet. As shown in FIG. 20, the nozzle assembly may also be utilized on bridges and be connected to supply piping 31, which may be connected through the bridge deck to a supply source on an underside. FIG. 22 shows a container 93 supplying epoxy to the anti-icing system 1 during the installation.

FIGS. 23A–23E show varying shapes of the nozzle, such as but not limited to, triangular, quadrilateral, pentagonal, hexagonal and cylindrical, respectively, with inlet 17 shown on top surfaces of the nozzles.

While the invention has been described with reference to specific embodiments, modifications and variations of the invention may be constructed without departing from the scope of the invention, which is defined in the following claims.

What is claimed is:

1. Surface treatment apparatus comprising a shaped nozzle of a block of solid material having top, side and bottom surfaces for spraying a substance/substances onto a vehicle travelled surface, said nozzle being flush mountable with the vehicle travelled surface to be treated, at least one inlet and at least one outlet connected to the nozzle, the at least one inlet being provided on at least one of the top, side or bottom surfaces of the nozzle, further comprising a supply removably connected to the at least one inlet for supplying substances to the nozzle, a channel connecting the at least one inlet to the at least one outlet.

2. The apparatus of claim 1, wherein the nozzle is integrally formed with the surface.

3. The apparatus of claim 1, further comprising at least one relief channel connected to the outlet.

4. The apparatus of claim 3, wherein each relief channel is adapted for spraying substances in a pattern on the surface.

5. The apparatus of claim 4, wherein the pattern is horizontal.

6. The apparatus of claim 4, wherein the pattern is a stream.

7. The apparatus of claim 3, further comprising a tube for connecting the at least one inlet to the at least one relief channel.

8. The apparatus of claim 3, wherein the relief channel has a diameter proportional to required flow rate and droplet size.

9. The apparatus of claim 3, wherein the relief channel has a spray angle sized to provide a maximum height of spray over the surface.

10. The apparatus of claim 1, further comprising an alignment base having an alignment plate, the nozzle being in the alignment base, openings on the alignment base and fasteners receivable in the openings for flush mounting the nozzle with the surface.

11. The apparatus of claim 10, further comprising alignment gauges on the alignment plate for aligning the base and the nozzle with the surface.

12. The apparatus of claim 1, wherein a flow of the substance is varied thereby changing a shape of a spray pattern independent of changes to pressure and flow rates of the substance.

13. The apparatus of claim 1, wherein the substance is an anti-icing substance and wherein the vehicle travelled surface is a bridge deck or a pavement or a parking ramp.

14. The apparatus of claim 1, wherein the nozzle is of composite material.

15. The apparatus of claim 1, wherein the nozzle is of stainless steel material.

16. The apparatus of claim 1, wherein the nozzle is of metal.

17. The apparatus of claim 1, wherein the nozzle is die cast.

18. The apparatus of claim 1, wherein the nozzle is molded.

19. The apparatus of claim 1, further comprising a check valve in the inlet.

20. The apparatus of claim 1, further comprising a flow regulator in the inlet.

21. The apparatus of claim 1, wherein the nozzle is a fan-shaped spray nozzle further comprising spray holes for spraying the substance received from the inlet.

22. The apparatus of claim 1, wherein the nozzle has plural shapes.

23. The apparatus of claim 22, wherein the shapes are selected from a group consisting of circular, cylindrical, quadrilateral, pentagonal, hexagonal or triangular shapes.

24. The apparatus of claim 1, further comprising at least one sensor on the nozzle.

25. The apparatus of claim 24, wherein the sensor is a pavement temperature probe.

26. The apparatus of claim 24, wherein the sensor is an ambient condition sensor.

27. The apparatus of claim 24, wherein the sensor is an ambient temperature sensor.

28. The apparatus of claim 24, wherein the sensor is a pavement temperature probe.

29. The apparatus of claim 24, wherein the sensor is a plurality of conductivity sensors.

30. The apparatus of claim 1, further comprising programs for automatically driving a pump assembly in response to conditions sensed by the sensor indicating need for surface treatment substances.

31. The apparatus of claim 1, further comprising wear indicators on the nozzle for indicating wear and tear condition of the nozzle.

32. The apparatus of claim 31, wherein the wear indicator is a surface plate on the nozzle.

33. The apparatus of claim 1, further comprising a supply manifold provided proximal the nozzle, and a pipe supply connecting the manifold to the nozzle for supplying anti-icing substances to the nozzle.

34. The apparatus of claim 33, further comprising a junction box in the manifold.

35. The apparatus of claim 1, further comprising an automation system connected to the nozzle for automatic control of the nozzle to cover a large target area with a deicing liquid spray.

36. The apparatus of claim 35, wherein the automation system comprises instrumentation to measure surface conditions and events.

37. The apparatus of claim 36, wherein the surface conditions include temperature, humidity, moisture and precipitation.

38. The apparatus of claim 1, wherein the nozzle is of a non-corroding material.

39. The apparatus of claim 38, wherein the material is nylon or stainless steel.

40. The apparatus of claim 1, wherein the at least one of the top, side or bottom surfaces of the nozzle is on the bottom side.

41. The apparatus of claim 1, wherein the at least one of the top, side or bottom surfaces of the nozzle is on the top side.

42. The apparatus of claim 1, wherein the at lest one of the top, side or bottom surfaces of the nozzle is on the side between the top and the bottom of the nozzle.

43. Surface treatment apparatus comprising a shaped nozzle for spraying a substance onto a surface, said nozzle being flush mountable with the surface to be treated, at least one inlet and at least one outlet connected to the nozzle, further comprising an alignment base having an alignment plate, the nozzle being in the alignment base, openings on the alignment base and fasteners receivable in the openings for flush mounting the nozzle with the surface, further comprising an access hole in the alignment plate and a groove in the base communicating with the access hole for receiving a bonding substance during installation to form a tight bond between the nozzle and the surface.

44. Surface treatment apparatus comprising a shaped nozzle for spraying a substance onto a surface, said nozzle being flush mountable with the surface to be treated, at least one inlet and at least one outlet connected to the nozzle, further comprising an alignment base having an alignment plate, the nozzle being in the alignment base, openings on the alignment base and fasteners receivable in the openings for flush mounting the nozzle with the surface, further comprising complementary openings in the alignment plate, the fasteners receivable in the openings for flush mounting the nozzle with the surface.

45. Surface treatment apparatus comprising a shaped nozzle for spraying a substance onto a surface, said nozzle being flush mountable with the surface to be treated, at least one inlet and at least one outlet connected to the nozzle, further comprising an installation device having an installation guide for removably attaching to the nozzle for alignment of the nozzle with the surface.

46. The apparatus of claim 45, further comprising openings in the installation guide and fasteners receivable in the openings for removably attaching the guide to the nozzle for flush mounting with the surface.

47. The apparatus of claim 45, further comprising an access hole in the guide for supplying bonding material for bonding the nozzle with the surface.

48. The apparatus of claim 45, further comprising standoffs on the guide for protecting the installation device from debris.

49. The apparatus of claim 45, wherein the installation device is of non-corroding material.

50. The apparatus of claim 49, wherein the material is metal or plastic.

51. Surface treatment apparatus comprising a shaped nozzle for spraying a substance onto a surface, said nozzle being flush mountable with the surface to be treated, at least one inlet and at least one outlet connected to the nozzle, further comprising wear indicators on the nozzle for indicating wear and tear condition of the nozzle, wherein the wear indicator is a surface plate on the nozzle, wherein the surface plate has at least two laminates, wherein one laminate is of a high visibility color when destroyed exposing the other laminate.

52. The apparatus of claim 51, wherein the wear indicator is an infrared signature indicating when the top laminate is worn off.

53. Surface treatment apparatus comprising a shaped nozzle for spraying a substance onto a surface, said nozzle being flush mountable with the surface to be treated, at least one inlet and at least one outlet connected to the nozzle, further comprising an automation system connected to the nozzle for automatic control of the nozzle to cover a large target area with a deicing liquid spray, wherein the automation system comprises instrumentation to measure surface conditions and events, wherein the events include traffic count, vehicle weight and vehicle length.

54. Apparatus for spraying substances comprising a nozzle of a block of solid material having top, side and bottom surfaces flush-mounted in vehicle travelled surfaces for spraying substances on the vehicle travelled surfaces, the nozzle having an inlet on at least one of the top, side or bottom surfaces of the nozzle for receiving substances and an outlet connected to the inlet for expressing the substances.

55. The apparatus of claim 54, wherein the nozzle is substantially flat.

56. The apparatus of claim 54, wherein the nozzle is cylindrical.

57. The apparatus of claim 56, wherein the side surfaces form sidewalls connecting the top and the bottom surfaces.

58. The apparatus of claim 57, wherein a height of the sidewalls is less than a width of the top or bottom sides of the nozzle.

59. The apparatus of claim 54, wherein the at least one of the top, side or bottom surfaces is on the top side of the nozzle.

60. The apparatus of claim 54, wherein the at least one of the top, side or bottom surfaces is on the bottom side of the nozzle.

61. The apparatus of claim 54, wherein the at least one of the top, side or bottom surfaces is on the side surface of the nozzle.

62. The apparatus of claim 54, further comprising a supply removably connected to the inlet of the nozzle for supplying substances to be sprayed.

63. The apparatus of claim 54, wherein the substances are deicing substances.

64. The apparatus of claim 54, further comprising at least one relief channel connected to the outlet for patterned spraying of substances on the surfaces.

65. The nozzle of claim 54, wherein the nozzle is of composite material.

66. The nozzle of claim 54, wherein the nozzle is of metal.

67. The nozzle of claim 66, wherein the metal is stainless steel.

68. The nozzle of claim 67, wherein the nozzle is cast or molded.

69. A nozzle for flush mounting and spraying substances on a vehicle travelled surface comprising a block of solid material having upper, side and bottom surfaces and wherein the upper surface is a flat surface and having a relatively large diameter inlet in a side or bottom surface, angularly related grooves in the upper surface, the grooves having inner and outer ends and the grooves sloping upwardly from the inner ends and having shallow outer ends at intersections of the side and upper surfaces, the inner ends of the grooves having relatively small openings connecting the grooves to the relatively large diameter inlet.

70. The nozzle of claim 69, wherein the openings are perpendicular to the inner ends of the grooves.

* * * * *